US010691073B2

(12) United States Patent
Nicolas et al.

(10) Patent No.: US 10,691,073 B2
(45) Date of Patent: Jun. 23, 2020

(54) REMOVABLE BRACELET FOR HOROLOGY OR JEWELLRY

(71) Applicant: The Swatch Group Research and Development Ltd, Marin (CH)

(72) Inventors: Cedric Nicolas, Neuchatel (CH); Nicolas Francois, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 51 days.

(21) Appl. No.: 16/103,063

(22) Filed: Aug. 14, 2018

(65) Prior Publication Data

US 2019/0064744 A1 Feb. 28, 2019

(30) Foreign Application Priority Data

Aug. 28, 2017 (EP) ..... 17188055

(51) Int. Cl.
*G04B 37/14* (2006.01)
*A44C 5/20* (2006.01)
*A44C 5/14* (2006.01)

(52) U.S. Cl.
CPC ..... *G04B 37/1486* (2013.01); *A44C 5/145* (2013.01); *A44C 5/2028* (2013.01); *A44C 5/2061* (2013.01)

(58) Field of Classification Search
CPC ... G04B 37/1486; A44C 5/145; A44C 5/2028; A44C 5/2061; A44C 5/14; A44C 11/00; Y10T 24/45408; Y10T 24/4718
See application file for complete search history.

(56) References Cited

U.S. PATENT DOCUMENTS 1,508,612 A * 9/1924 Potter ..... A44C 5/145 24/600.7
1,630,498 A * 5/1927 Person ..... A44C 5/145 24/600.9
1,653,058 A 12/1927 Nelson
1,662,628 A * 3/1928 Augenstein ..... A44C 5/145 24/600.9

(Continued)

OTHER PUBLICATIONS

European Search Report dated Jan. 29, 2018 in European Application 17188055.2 filed Aug. 28, 2017 (with English Translation of Categories of Cited Documents).

*Primary Examiner* — Robert Sandy
*Assistant Examiner* — Rowland Do
(74) *Attorney, Agent, or Firm* — Oblon, McClelland, Maier & Neustadt, L.L.P.

(57) ABSTRACT

A removable bracelet for horology or jewellery, with a bracelet portion arranged to confine a watch or jewellery bar, including, at the end thereof a chamber arranged for housing the bar, the chamber including a lateral opening on a first side of the bracelet portion for the insertion or removal of the bar, the bracelet portion including a pusher controlling a tongue movable in a longitudinal direction against a spring, the pusher is movable in a transverse direction and includes a first profile arranged to cooperate with a second profile of the tongue to transform the transverse motion of the pusher into a longitudinal motion of the tongue, the bracelet includes a closure arranged on the first side for retaining the pusher in the depth of the bracelet portion.

15 Claims, 6 Drawing Sheets

(56) References Cited

U.S. PATENT DOCUMENTS

| | | | | | |
|---|---|---|---|---|---|
| 1,675,324 | A | * | 7/1928 | Augenstein | A44C 5/145 24/600.9 |
| 1,692,809 | A | * | 11/1928 | Bigney | A44C 5/14 63/5.1 |
| 2,876,521 | A | * | 3/1959 | Legman | A44C 5/145 24/265 WS |
| 3,036,353 | A | | 5/1962 | Minutoli | |
| 3,644,967 | A | * | 2/1972 | Romanzi, Jr. | A44B 11/2511 24/642 |
| 9,498,029 | B2 | * | 11/2016 | Schooley | A44C 5/2057 |
| 2016/0262504 | A1 | | 9/2016 | Schooley et al. | |
| 2017/0035158 | A1 | | 2/2017 | Schooley et al. | |
| 2017/0258186 | A1 | | 9/2017 | Schooley et al. | |

* cited by examiner

REMOVABLE BRACELET FOR HOROLOGY OR JEWELLRY

This application claims priority from European Patent Application No. 17188055.2 filed on Aug. 28, 2017; the entire disclosure of which is incorporated herein by reference

FIELD OF THE INVENTION

The invention concerns a timepiece or piece of jewellery comprising at least one bar, and comprising a removable bracelet or wristband including at least one bracelet portion arranged to be assembled with a watch or jewellery bar, the bar being inscribed within a geometric envelope of given profile and given dimensions, the bracelet including, at the end of said at least one bracelet portion, a chamber of complementary profile and dimensions to said given profile and to said given dimensions and arranged for housing a bar, said chamber including a lateral opening on a first side of said bracelet portion for the insertion or removal of said bar, said bracelet portion including a tongue movable in a longitudinal direction of said bracelet portion against an elastic return means and further including a pusher for controlling said tongue, said pusher being movable in a transverse direction substantially perpendicular to said longitudinal direction and along the thickness or depth of said bracelet portion, and including a first profile arranged to cooperate with a second profile of said tongue for the transformation of a transverse motion of said pusher into a longitudinal motion of said tongue, and said bracelet including a means of closure arranged on said first side for retaining said pusher in the depth of said bracelet portion.

The invention concerns the field of horology or jewellery.

BACKGROUND OF THE INVENTION

A watch or jewellery bracelet is an important accessory, which must both be comfortable for the user to wear and ensure that the watch or piece of jewellery is securely held, in all circumstances and particularly during professional or sports use, during which the object may be subjected to high accelerations.

The bracelet contributes significantly to the aesthetics of the watch or piece of jewellery, gives it its own distinctive look, and reveals the style of the user or of the clothes he wears, which explains the advantage of removable bracelets, which are designed for customization of the object, and which are intended to be changed by the user himself.

However, it is rare to find bracelets that successfully combine perfect aesthetics, impeccably secure hold, high robustness, and ease of changeability by the user, particularly without requiring a specific tool.

U.S. Pat. No. 1,653,058A in the name of NELSON discloses a bracelet end hook with a closing tongue operable through the side thereof.

U.S. Pat. No. 3,036,353A in the name of MINUTOLI discloses a bracelet end connecting mechanism, similar to a clasp mechanism with spring-loaded pushers.

SUMMARY OF THE INVENTION

The invention proposes to define a bracelet provided with a fastening system that meets all these requirements, designed for the most common case of a watch or piece of jewellery having a connecting bar, and preventing disassembly of this bar, if however, this is possible, since, particularly in jewellery, the bar generally cannot be disassembled from the body of the piece of jewellery.

To this end, the invention concerns a timepiece or piece of jewellery comprising at least one bar and comprising a bracelet according to claim 1.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
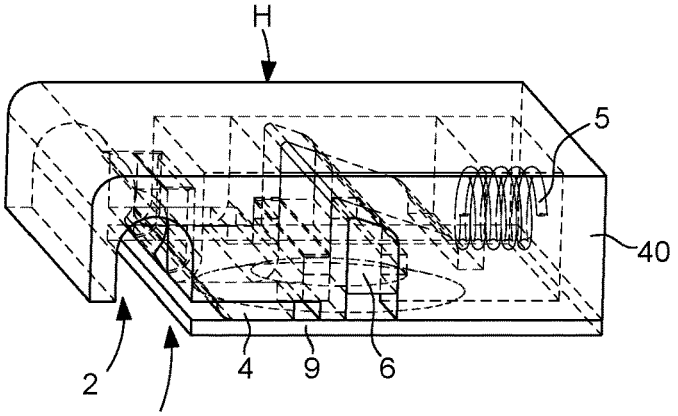
FIG. 1 represents a schematic and perspective view of a bracelet end according to the invention, especially made in the form of an insert that is easy to adapt to an existing bracelet portion, comprising a chamber arranged to confine a bar, said chamber includes an opening which can be closed by a tongue whose travel is controlled by a spring-loaded pusher, said insert is represented in an open position which allows the bracelet to be changed.
Figure 2:
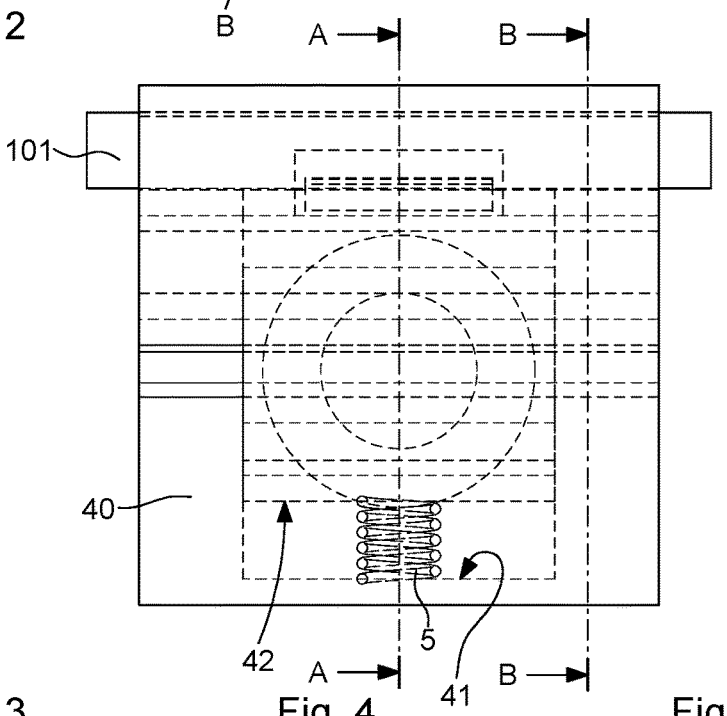
FIG. 2 represents a schematic, top view of the assembly formed by the insert of FIG. 1, in cooperation with a bar which protrudes from each side.
Figure 3:
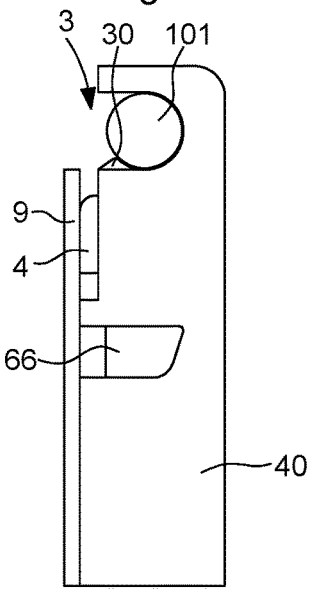
FIG. 3 is a side view of the assembly of FIG. 2, in an open position which allows the bracelet to be changed.
Figure 4:
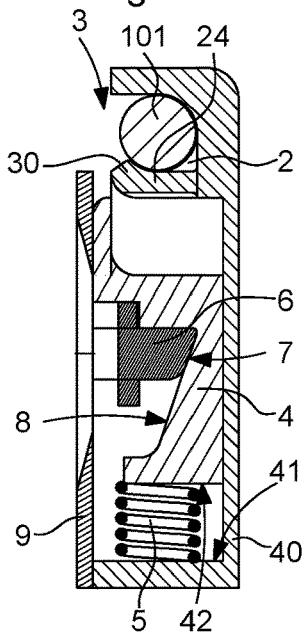
FIG. 4 is a cross-sectional view of the same assembly, in the same position, along cross-section AA of FIG. 2, showing the pusher compressing a return spring and releasing the tongue from the opening in the chamber.
Figure 5:
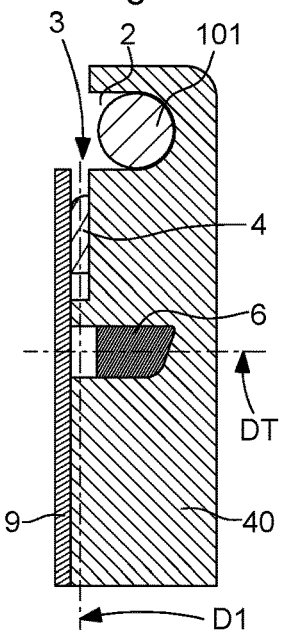
FIG. 5 is a cross-sectional view of the same assembly, in the same position, along cross-section BB of FIG. 2, showing the pusher guided in its travel.
Figure 6:
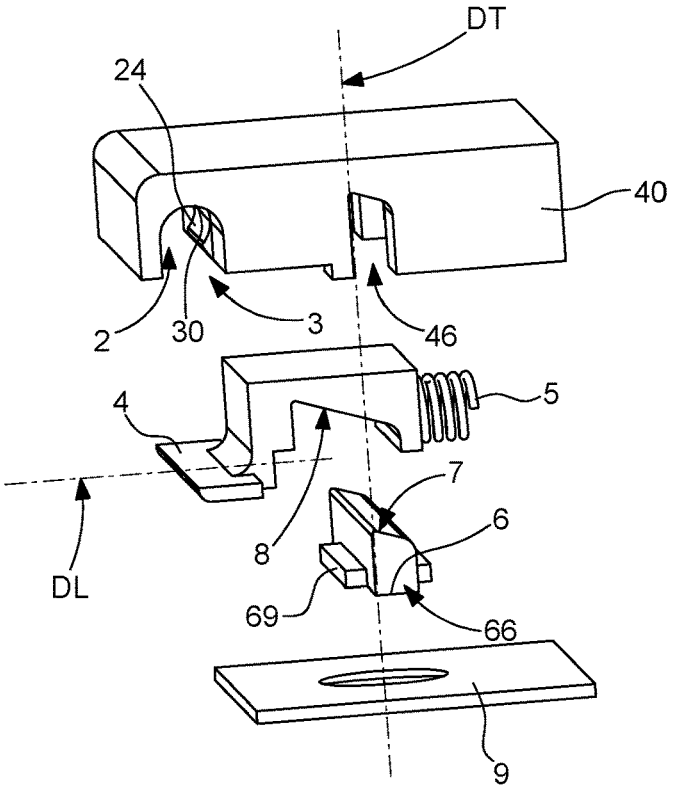
FIG. 6 represents a schematic view of the same insert by itself in an exploded perspective top view.
Figure 7:
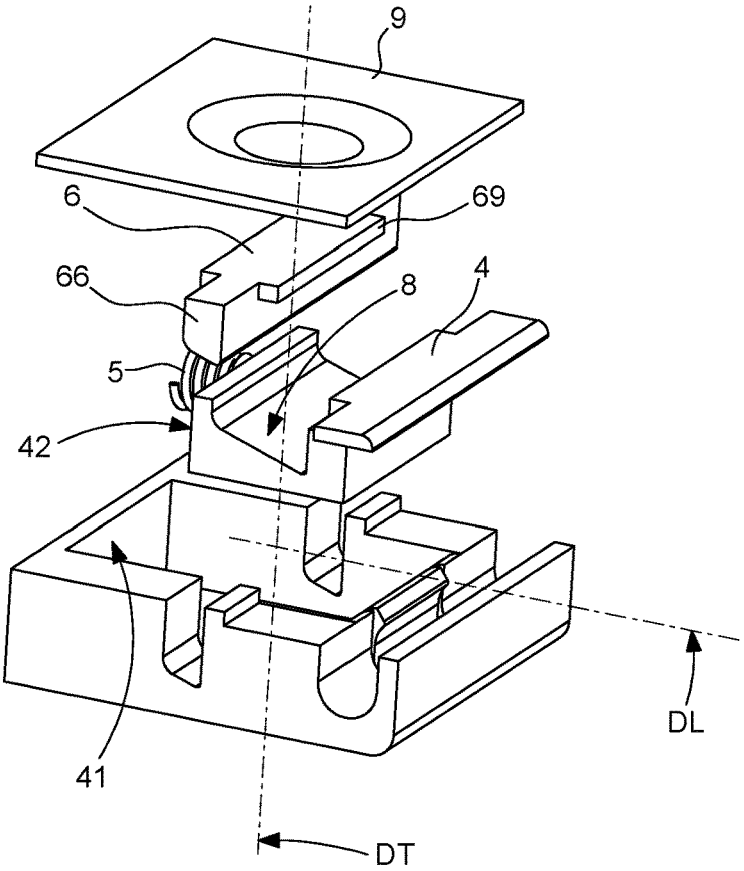
FIG. 7 represents a schematic view of the same insert by itself in an exploded perspective bottom view.
Figure 8:
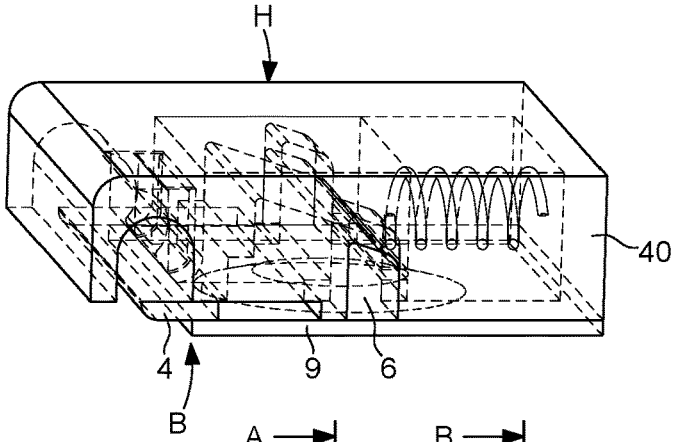
FIGS. 8 to 14 are identical to FIGS. 1 to 7, but in a closed position where the bar cannot move past the tongue without deliberate action by the user, and with the return spring at its maximum extension.
Figure 9:
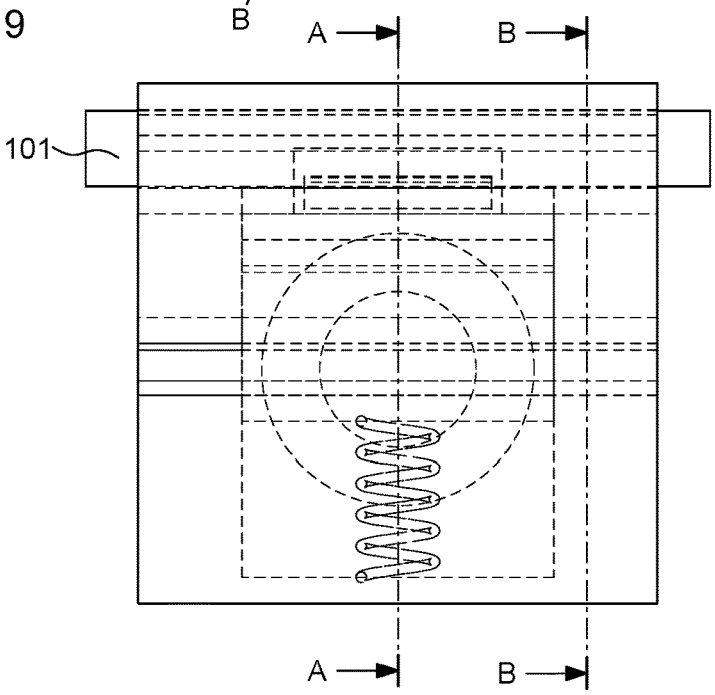
Figure 10:
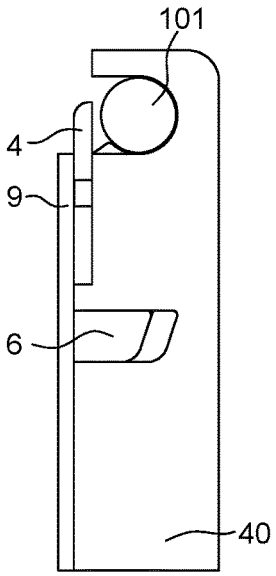
Figure 11:
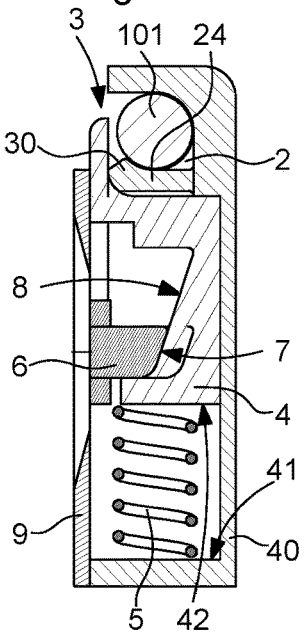
Figure 12:
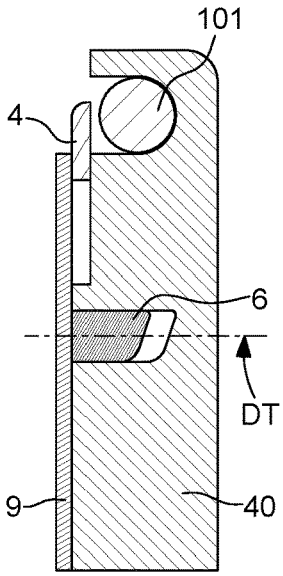
Figure 13:
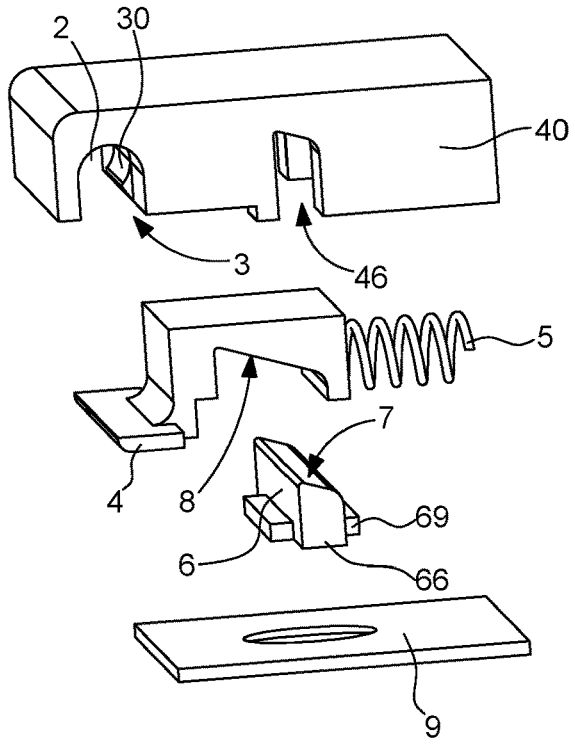
Figure 14:
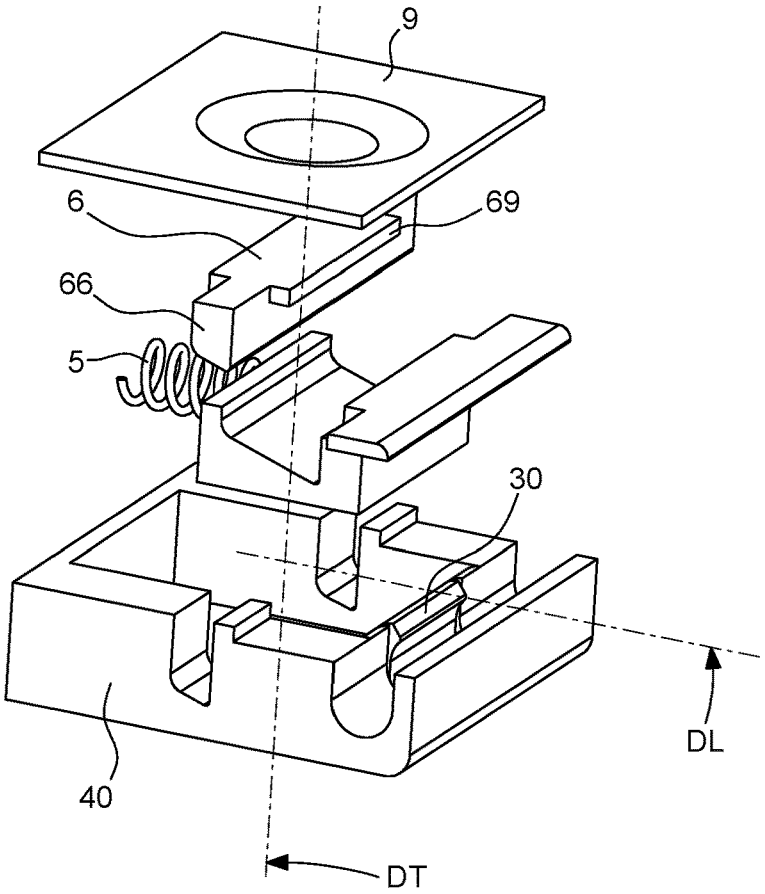

The invention concerns a timepiece or piece of jewellery, particularly a watch 1000 or a piece of jewellery 2000, comprising a connecting bar 101, 102, and comprising a bracelet 100, provided with a fastening system for incorporation into such a watch 1000 or into such a piece of jewellery 2000, and designed such that said bar can remain in place in watch 1000 or piece of jewellery 2000 when its bracelet is changed.

This removable timepiece or jewellery bracelet 100 includes at least one bracelet portion 1 arranged to be assembled to a watch or jewellery bar.

This bar 101, 102, is inscribed within a geometric envelope of given profile and of given dimensions.

Bracelet 100 includes, at the end of a bracelet portion 1, a chamber 2 of complementary profile and dimensions to said given profile and to said given dimensions, and which is arranged to house and confine a bar 101, 102.

It is understood that bracelet 100 may be a universal bracelet, able to be mounted on numerous commercial watch cases which have relatively standard bars, at least as regards their diameters, but may also be a bracelet specific to a watch case or piece of jewellery comprising bars having a special profile, so as to prevent assembly of any bracelet that could impair the object or make it appear commonplace.

The Figures illustrate the particular case of a bracelet 100 including an insert 40 at the end of a bracelet portion, which has the advantage of being capable of series production and of reducing storage costs.

However, a bracelet, for example made of ceramic or metallic or other material, may evidently comprise a bracelet portion whose end is directly equipped as described below in this particular and preferred application to the case of the bracelet with an insert.

Chamber 2, particularly but not limited to a chamber made in the structure of insert 40, includes a lateral opening 3 on a first side of bracelet portion 1, for the insertion or removal of the bar. This bracelet portion 1 includes a tongue 4 movable in a longitudinal direction DL of bracelet portion 1 against an elastic return means 5 and further includes a pusher 6 for controlling tongue 4.

Pusher 6 is movable in a transverse direction DT substantially perpendicular to longitudinal direction DL and along the thickness or depth of bracelet portion 1 and includes a first profile 7 arranged to cooperate with a second profile 8 comprised in tongue 4, to transform a transverse motion of pusher 6 into a longitudinal motion of tongue 4, particularly on a plane surface that slopes with respect both to transverse direction DT and to longitudinal direction DL.

Bracelet 100 includes a means of closure 9, which is arranged on the first side, for retaining pusher 6 in the depth of bracelet portion 1 or of its insert 40.

More particularly, closure means 9 includes an overmoulded lip 10 made of flexible material, such as elastomer, rubber, silicone or similar, which is arranged to permanently confine pusher 6 in the depth of bracelet portion 1 or of its insert 40.

More particularly, overmoulded lip 10 is arranged to permanently confine elastic return means 5 in the depth of bracelet portion 1 or of its insert 40, as seen in FIGS. 18, 19, 20, 22.

More particularly, overmoulded lip 10 is arranged to permanently confine tongue 4 in the depth of bracelet portion 1 or of its insert 40, as seen in FIGS. 17, 18, 19, 20, 21.

In a particular embodiment, overmoulded lip 10 is in one piece with bracelet portion 1, it can, in particular secure together the portion and insert 40 comprised therein.

An alternative to overmoulding is to use the flexibility of the material from which the bracelet portion is made, for example leather, textile, elastomer, rubber, silicone, or suchlike, the bracelet portion being made to form a pocket inside which the insert is permanently confined.

In both cases, the user can operate pusher 6 through the 'skin' of the bracelet portion, by pressure in transverse direction DT. Pusher 6, embedded in the depth of the bracelet portion, has no contact with the exterior and cannot be operated unintentionally.

More particularly, pusher 6 includes stop means 69 arranged to cooperate in abutment with closure means 9, as seen in FIGS. 6, 7, 13 and 14. The pusher thus remains confined inside its housing regardless of its position.

In an advantageous embodiment, notably allowing the user to feel whether the bar has been properly inserted or removed, chamber 2 is separated from opening 3 by at least one raised notch 30 arranged in a flexible wall of chamber 2 or borne by a flexible lip 24 delimiting one side of chamber 2.

The closure system may also include a foolproof system to ensure that the bar is properly inserted and confined inside its chamber, and that the system can close correctly, for example in the form of a curved, flexible metal strip at the bottom of chamber 2, which is deformed when the bar reaches a stop surface, thus producing a 'click' to indicate that the bar is in the proper position in its chamber. This strip protrudes through opening 3 when the bar is not at the bottom of the housing, and, when the bar is at the bottom of the housing, it deforms the strip which retracts inside chamber 2 and no longer protrudes through opening 3. This strip can be made of shape memory material or amorphous metal.

More particularly, tongue 4 forms a slide which is movable, only in longitudinal direction DL, in a bracket of an insert 40 comprised in bracelet 100.

More particularly, this clevis of insert 40 includes, extending in transverse direction DT, transverse guide means 46 arranged to guide the travel of complementary guide means 66 comprised in pusher 6, as seen in FIGS. 3, 6, 7, 13 and 14.

More particularly, elastic return means 5, notably formed by a spring, a helical spring in the case of the Figures, is confined between a wall 41 of the clevis of insert 40 and a bearing face 42 of tongue 4.

More particularly, chamber 2 is arranged in the depth of the clevis of insert 40.

And, more particularly, the clevis of insert 40 includes at least one flexible lip 24 arranged to cooperate in abutment on the bar after its insertion.

Insert 40 can be produced by moulding, for example metallic powder moulding. Elastic return means 5 may be in one piece with the body of the insert, for example in the form of a zigzag spring.

Naturally, additional safety devices can also be added, such as a quarter-turn lock by an embedded latch (of the aeronautic fastener 'Rivkle' type or similar) before allowing access to the pusher, this latch may include the manufacturer's logo and require a particular angular orientation in order to open.

Figure 15:
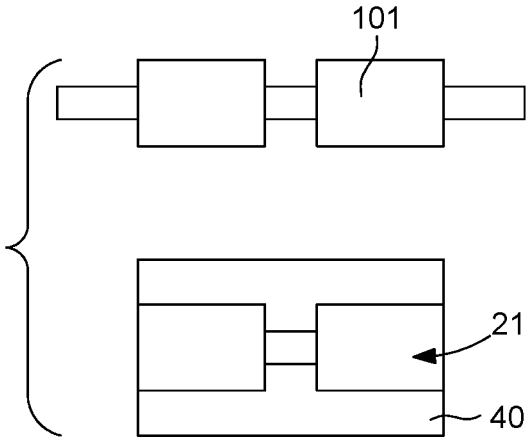
FIGS. 15 and 16 each illustrate a particular profile of the bar, and of the corresponding housing of the insert chamber, to differentiate between an upper portion and a lower portion of the same bracelet.
Figure 16:
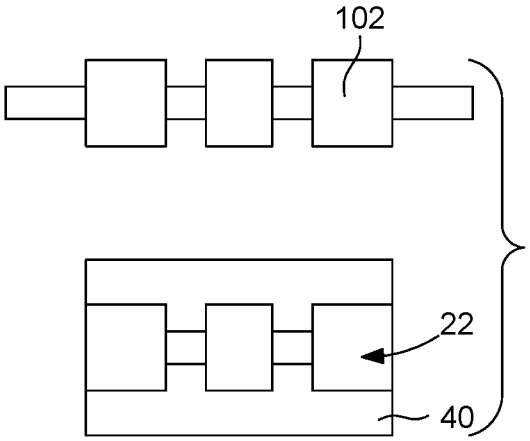
Figure 23:
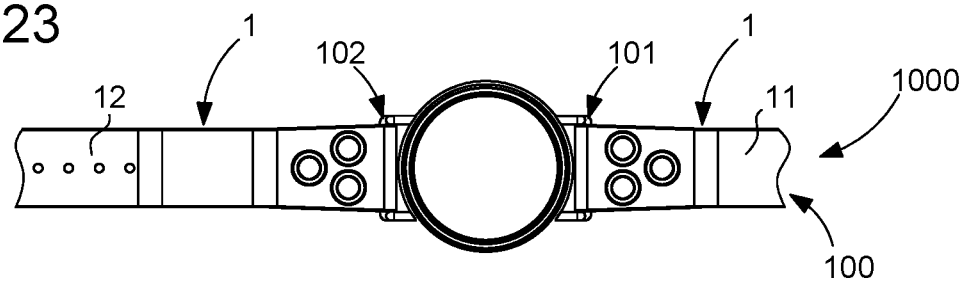
FIGS. 23 and 24 represent a watch and a piece of jewellery respectively, each including a bracelet thus equipped.
Figure 24:
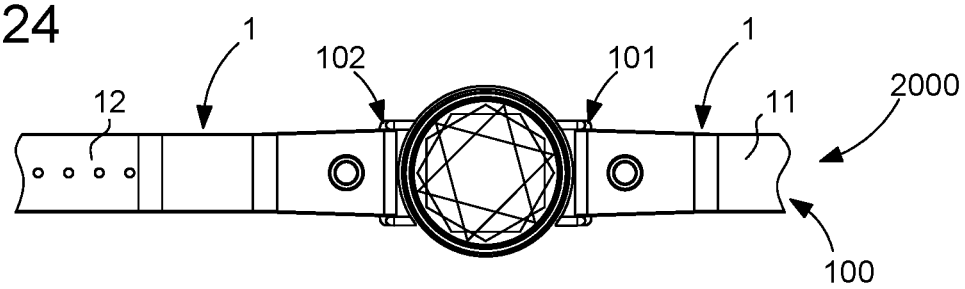
Figure 17:
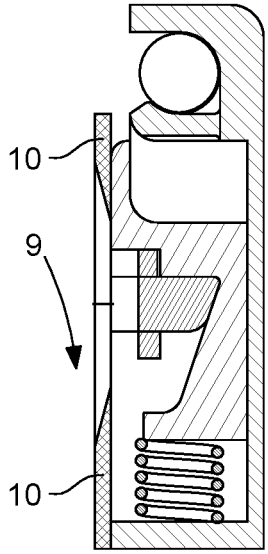
FIGS. 17 to 22 illustrate, in similar cross-sectional views to FIG. 4, embodiments comprising an overmoulded lip, represented in cross-hatching, immobilising inside the insert all or part of its components: the tongue in FIG. 17, the tongue and the return spring in FIG. 18, the tongue and the pusher and the return spring in FIGS. 19 and 21, the tongue and the pusher in FIG. 20, the pusher and the return spring in FIG. 22.
Figure 18:
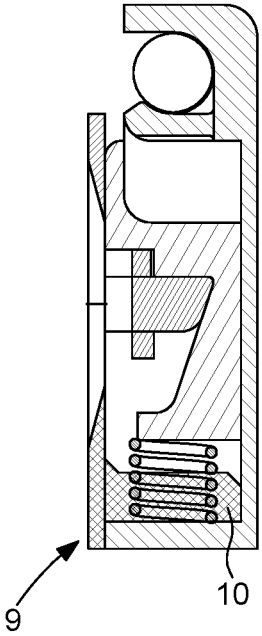
Figure 19:
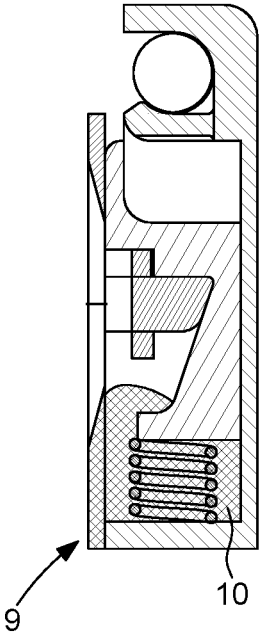
Figure 20:
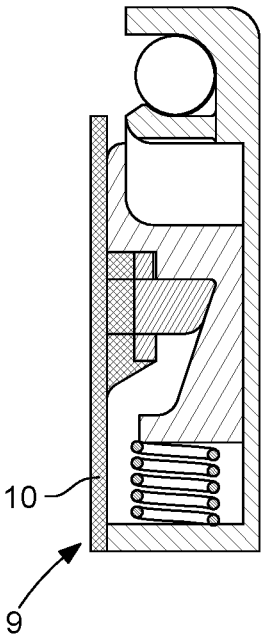
Figure 21:
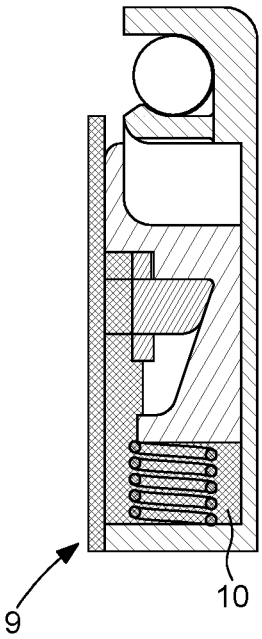
Figure 22:
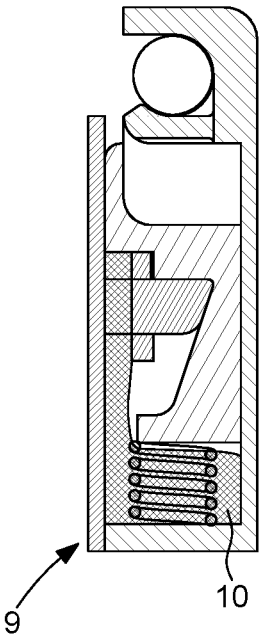

To distinguish between an upper bracelet portion and lower bracelet portion, in a particular embodiment of the invention, bracelet 100 includes a first bar 101 inscribed within a first geometric envelope, and a first bracelet portion 11 whose first chamber 21 is sized to receive first bar 101, and bracelet 100 includes a second bar 102 inscribed within a second geometric envelope different from the first geometric envelope, and a second bracelet portion 12 whose second chamber 22 is sized to receive second bar 102 but not first bar 101, first chamber 21 being unable to receive second bar 102, as illustrated in a particular example in FIGS. 15 and 16, including grooves disposed at different places. Other means of differentiation are possible: by the diameter of the bars, by the shape of their cross-section (square, triangular, hexagonal, or otherwise). This particular arrangement puts a stop to counterfeits.

It is also possible, by means of such a differentiated assembly, to design bracelets for left handed people.

The invention more particularly concerns a watch 1000 comprising such a bracelet 100, arranged to receive a first bar 101 on first horns and a second bar 102 on second horns, so as to distinguish between a first upper portion 11 arranged to be attached to the first horns, and a second lower portion 12 arranged to be attached to second horns.

The invention more particularly concerns a piece of jewellery 2000 including such a bracelet 100, and which may evidently include all the arrangements set out above and is particularly arranged to receive a first bar 101 on first horns, and a second bar 102 on second horns, so as to distinguish a first upper portion 11 arranged to be attached to the first horns, and a second lower portion 12 arranged to be attached to the second horns.

What is claimed is:

1. A timepiece or piece of jewellery comprising a first bar and a second bar;

a removable bracelet or wristband including a first bracelet portion and a second bracelet portion each bracelet portion arranged to be assembled with a watch or jewellery bar;

each bracelet portion having an end that includes a chamber arranged for housing one of said first bar and said second bar: said chamber including a lateral opening on a first side of said respective bracelet portion for the insertion or removal of said respective bar;

each bracelet portion including a tongue movable against an elastic return in a longitudinal direction of said respective bracelet portion, a pusher that controls said tongue, said pusher being movable in a transverse direction of said respective bracelet portion, said transverse direction being perpendicular to said longitudinal direction, and said pusher including a first profile shaped to cooperate with a second profile of said tongue to transform a transverse motion of said pusher into a longitudinal motion of said tongue; and said respective bracelet portion including a closure arranged on said first side, said closure retaining said pusher in a depth of said respective bracelet portion, wherein said first bar has a first geometric shape and said second bar has a second geometric shape, said second geometric shape being different from said first geometric shape, wherein said chamber of said first bracelet portion is shaped to receive said first bar and, said chamber of said second bracelet portion is shaped to receive said second bar, wherein said first bar, said second bar, said chamber of said first bracelet portion, and said chamber of said second bracelet portion are respectively shaped such that; said second bar cannot be inserted into said chamber of said first bracelet portion, and said first bar cannot be inserted into said chamber of said second bracelet portion.

2. The timepiece or piece of jewellery according to claim 1, wherein each said closure includes an overmoulded lip made of flexible material arranged to permanently confine said pusher in the depth of said respective bracelet portion.

3. The timepiece or piece of jewellery according to claim 2, wherein said overmoulded lip is arranged to permanently confine said elastic return in the depth of said respective bracelet portion.

4. The timepiece or piece of jewellery according to claim 2, wherein said overmoulded lip is arranged to permanently confine said tongue in the depth of said respective bracelet portion.

5. The timepiece or piece of jewellery according to claim 2, wherein said overmoulded lip is in one piece with said respective bracelet portion.

6. The timepiece or piece of jewellery according to claim 1, wherein each said pusher includes a stop arranged to cooperate in abutment with said respsective closure.

7. The timepiece or piece of jewellery according to claim 1, wherein each said chamber includes at least one notch arranged in a flexible wall of said respective chamber or borne by a flexible lip delimiting one side of said respective chamber.

8. The timepiece or piece of jewellery according to claim 1, wherein each bracelet portion comprise an insert that includes a clevis, and each said tongue forms a slide movable only in said longitudinal direction in the clevis of said insert.

9. The timepiece or piece of jewellery according to claim 8, wherein each said clevis includes a transverse guide that extends in said transverse direction, said transverse guide being arranged to guide travel of a complementary guide, said pusher comprising said complementary guide.

10. The timepiece or piece of jewellery according to claim 8, wherein each said elastic return is confined between a wall of said respective clevis of said insert and a bearing face of said respective tongue.

11. The timepiece or piece of jewellery according to claim 8, wherein each said chamber is arranged in the depth of said respective clevis.

12. The timepiece or piece of jewellery according to claim 11, wherein each said chamber includes at least one notch arranged in a flexible wall of said respective chamber or borne by a flexible lip delimiting one side of said respective chamber, and wherein said respective clevis includes said flexible lip.

13. The timepiece or piece of jewellery according to claim 1, wherein the timepiece or piece of jewellery is a watch, and the timepiece or piece of jewellery further includes a first pair of horns and a second pair of horns, said first bar being arranged on said first pair of horns, and said second bar being arranged on said second pair of horns.

14. The timepiece or piece of jewellery according to claim 1, wherein the timepiece or piece of jewellery is a piece of jewellery, and wherein the timepiece or piece of jewellery further includes a first pair of horns and a second pair of horns, said first bar being arranged on said first pair of horns, and said second bar being arranged on said second pair of horns.

15. A timepiece or piece of jewellery comprising a first bar and a second bar;

a removable bracelet or wristband including a first bracelet portion and a second bracelet portion, each bracelet portion arranged to be assembled with a watch or jewellery bar;

each bracelet portion having an end that includes a chamber arranged for housing one of said first bar and said second bar; said chamber including a lateral opening on a first side of said respective bracelet portion for the insertion or removal of said respective bar;

each bracelet portion including a tongue movable against an elastic return in a longitudinal direction of said respective bracelet portion, a pusher that controls said tongue, said pusher being movable in a transverse direction of said respective bracelet portion, said transverse direction being perpendicular to said longitudinal direction, and said pusher including a first profile shaped to cooperate with a second profile of said tongue to transform a transverse motion of said pusher into a longitudinal motion of said tongue; and said respective bracelet portion including a closure arranged on said first side, said closure retaining said pusher in a depth of said respective bracelet portion, wherein said first bar has a first geometric shape, and said second bar has a second geometric shape, said second geometric shape being different from said first geometric shape, wherein said chamber of said first bracelet portion is shaped to receive said first bar and said chamber of said second bracelet portion is shaped to receive said second bar, wherein said second bar cannot be inserted into said chamber of said first bracelet portion, wherein said first bar cannot be inserted into said chamber of said second bracelet portion, and wherein each said chamber includes at least one notch arranged in a flexible wall of said respective chamber or borne by a flexible lip delimiting one side of said respective chamber.

* * * * *